US006584735B2

(12) United States Patent
Burton

(10) Patent No.: US 6,584,735 B2
(45) Date of Patent: Jul. 1, 2003

(54) VENTILATED WALL DRAINAGE SYSTEM AND APPARATUS THEREFORE

(75) Inventor: Dick A. Burton, 8 SW. AA Hwy., Kingsville, MO (US) 64061

(73) Assignees: Cobblestone Construction Finishes, Inc.; Dick A. Burton

( * ) Notice: Subject to any disclaimer, the term of this patent is extended or adjusted under 35 U.S.C. 154(b) by 109 days.

(21) Appl. No.: 09/752,093

(22) Filed: Dec. 29, 2000

(65) Prior Publication Data

US 2002/0083662 A1 Jul. 4, 2002

(51) Int. Cl.[7] ..... E04B 1/70; E04F 17/04

(52) U.S. Cl. ..... 52/95; 52/302.3; 52/741.3; 52/745.09

(58) Field of Search ..... 52/302.3, 95, 199, 52/169.5, 741.4, 741.3, 741.1, 745.09, 745.1

(56) References Cited

U.S. PATENT DOCUMENTS 4,523,519 A * 6/1985 Johnson ..... 454/185
4,916,875 A * 4/1990 Kashiwagi ..... 52/302.3
5,761,864 A * 6/1998 Nonoshita ..... 52/302.3

* cited by examiner

*Primary Examiner*—Michael Safavi
(74) *Attorney, Agent, or Firm*—Shook, Hardy & Bacon L.L.P.

(57) ABSTRACT

A building construction having a ventilated wall drainage system. The building includes a roof with a plurality of roof vents therein, a soffit, an attic space and an exterior wall construction. The wall construction includes an exterior wall covered with sheathing. The sheathing is in turn covered by insulation having a plurality of generally vertical channels therein which permit air to flow through the channels between the insulation and the sheathing of the exterior wall. The soffit is provided with a passage which is in communication with the channels in the insulation. Air is continually drawn through the channels in the wall construction, through the passage in the soffit and into the attic space to provide constant ventilation for the wall construction.

15 Claims, 2 Drawing Sheets

FIG. 5.
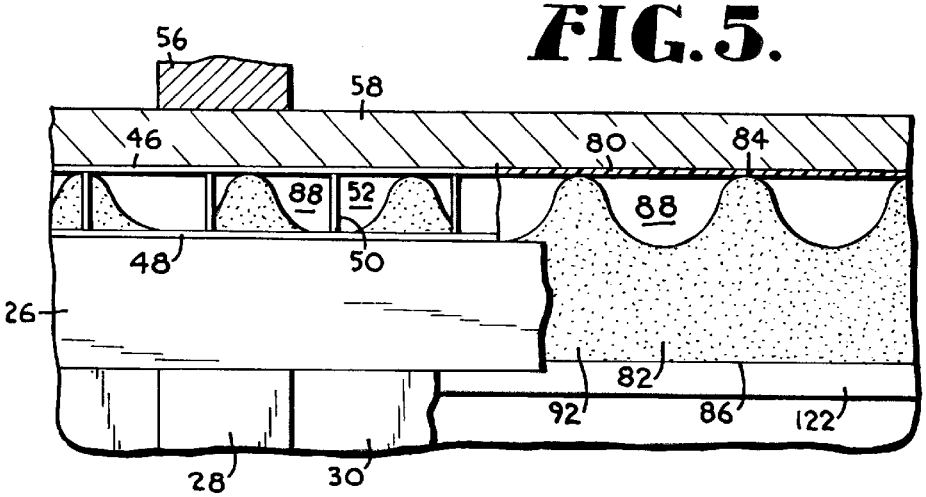
FIG. 6.
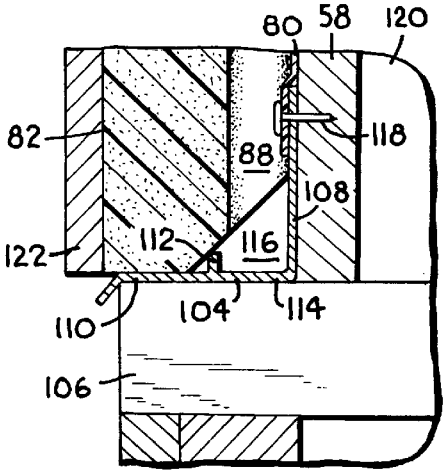
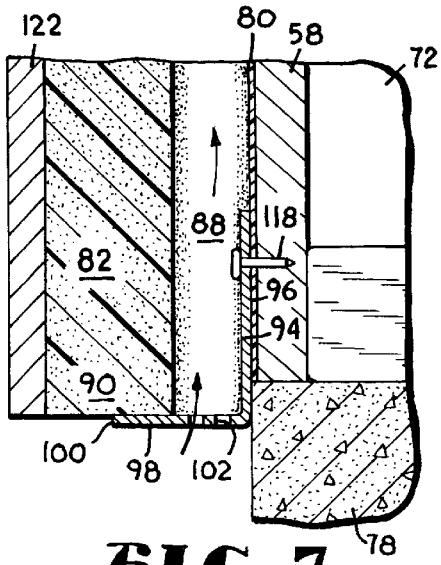
FIG. 7.
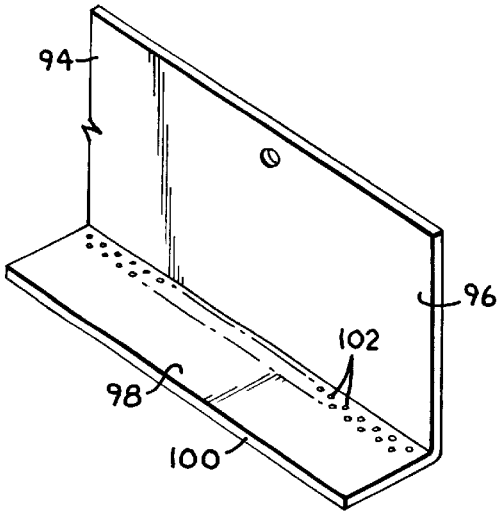
FIG. 8.

VENTILATED WALL DRAINAGE SYSTEM AND APPARATUS THEREFORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a ventilated wall drainage system for a building. More particularly, this invention relates to a method of constructing an exterior wall and a soffit in combination to provide for the free flow of air through the wall construction to vent the wall, drain the wall and prevent any moisture from damaging the wall construction.

In recent years, the popularity of Exterior Insulation and Finish Systems (EIFS) has risen dramatically. EIFS are multi-layered exterior wall systems that are used on both commercial buildings and homes. The rise in popularity of these systems can be attributed to greater design flexibility and improved energy efficiency.

Generally, these systems include an exterior wall having a sheathing material such as plywood or oriented strand board (OSB) to act as a substrate. A rigid foam insulation board is attached via an adhesive or mechanical fasteners to the substrate and the exterior of the insulation board is covered with a siding material such as synthetic stucco. Synthetic stucco usually consists of a durable water resistance base coat which is applied to the insulation and which receives a fiberglass mesh for added strength. A durable finish coat, typically using an acrylic co-polymer technology, is then applied. The finish coat is generally both color fast and crack resistant.

While this system provides many advantages over sidings of the prior art, one of the areas of concern has been that on occasion water or moisture will infiltrate this system. When water enters the system in the prior art, it cannot escape but is instead locked in the wall system. This moisture in the system eventually causes the materials to rot from the inside out, eventually creating the need for repairs.

One solution to the problem has been to provide various rubberized linings between the substrate of the exterior wall of the building and the insulation to prevent any moisture from entering the exterior wall. Another solution has been the use of insulation which includes channels in a rear surface thereof. This allows water that gets behind the insulation to flow through the channels and drain out the bottom of the insulation by gravity. While this system is an advance over the prior art, moisture can still remain in the channels and in the wall system for extended periods of time, thereby increasing the risk of rot.

Therefore, there is a need for a wall system which not only permits drainage of moisture which has infiltrated the system but which also is vented to provide continuous airflow through the system to dry out and/or evaporate any moisture. The present invention fills these and other needs.

BRIEF SUMMARY OF THE INVENTION

In order to overcome the above-stated problems and limitations, and to achieve the noted objects, there is provided a ventilated wall drainage system and a method of constructing the same.

In general the system includes a wall construction, a soffit, a roof, a roof vent in said roof and an attic space located between the soffit and the roof. The wall construction includes an exterior wall built in accordance with standard construction practices. The exterior wall preferably has a plurality of elongate vertical framing members arranged in a plane to define a wall. Exterior sheathing material, such as plywood or OSB, is then fastened to the framing members to define an exterior surface of the wall. To prevent air and moisture infiltration into the wall, the wall is then generally covered with a house wrap or vapor barrier. Foam board or generally rigid insulation is then fastened to the wall adjacent the house wrap. The insulation preferably includes a plurality of vertical channels therein adjacent the wall. The channels present openings in the bottom and top edges of the insulation such that air may freely flow through the insulation and between the insulation and the exterior wall.

An opening or passage is provided in the soffit which communicates with the channels such that air that flows through the channels may also flow through the passage into the soffit area. The air may then freely flow from the soffit up into the attic space and out one of the roof vents by the natural process of convection. The wall construction also includes an exterior siding material or covering. This covering can be synthetic stucco as described above or can include any other type of siding material.

The passage in the soffit is preferably provided by a spacer having a plurality of tunnels therethrough. The spacer is an elongate member which is fastened to the exterior of the wall directly above the channels in the insulation. The spacer accordingly holds the framing members of the soffit away from the exterior wall such that air may flow between the framing of the soffit and the exterior wall.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWING

The objects and features of the invention noted above are explained in more detail with reference to the drawing, in which like reference numerals denote like elements, and in which:

FIG. 5 is a top plan view taken generally along the line 5—5 in FIG. 4 and illustrating the cooperation between the spacer and the channels in the exterior wall;

FIG. 6 is an enlarged cross-sectional view of the exterior wall adjacent a window taken generally along the line 6—6 in FIG. 1;

FIG. 7 is an enlarged cross-sectional view of the exterior wall at a bottom end taken generally around the area 7 of FIG. 2; and FIG. 8 is a perspective view of a bracket of the present invention illustrating a plurality of drainage holes therein.

DETAILED DESCRIPTION OF THE INVENTION

Figure 1:
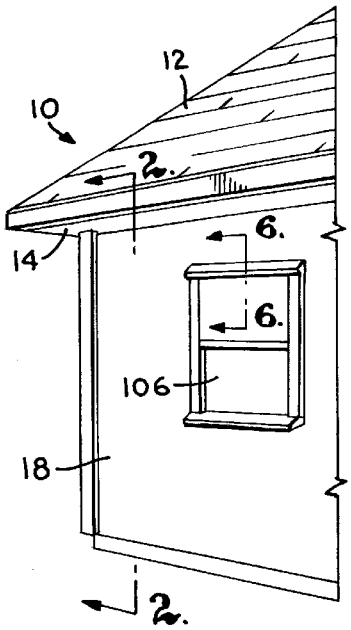
FIG. 1 is a perspective view of a side of a building constructed in accord with the present invention.
Figure 2:
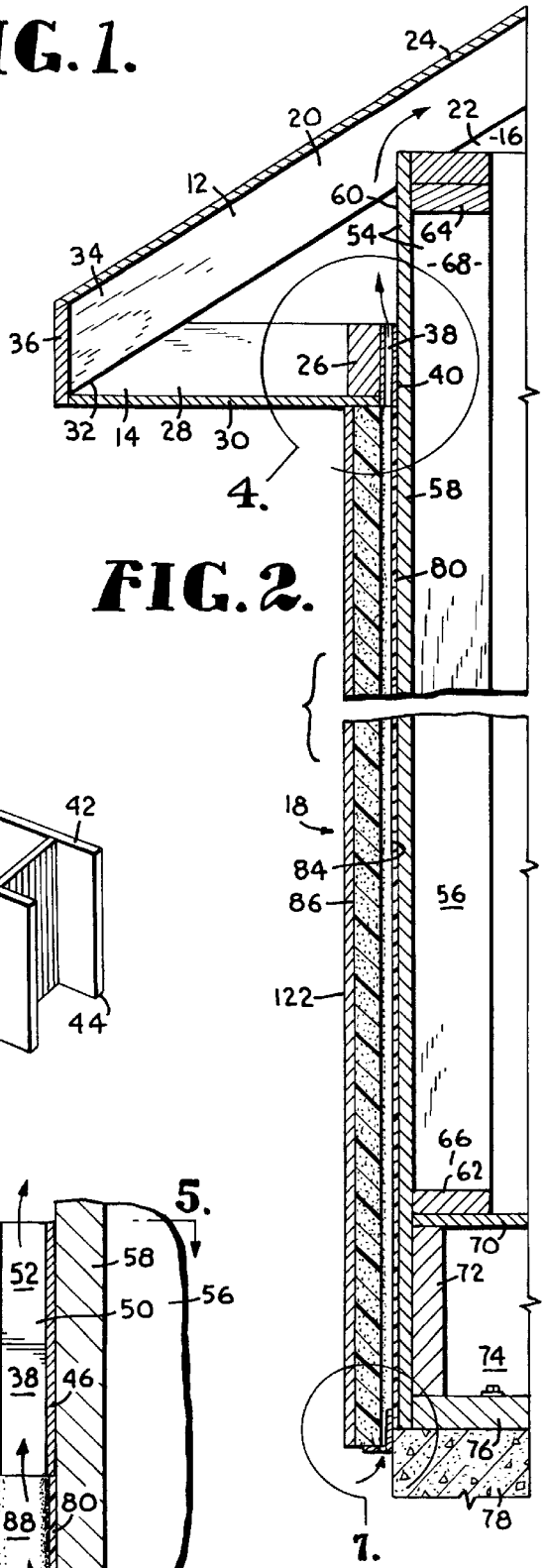
FIG. 2 is a cross-sectional view of the side of the building taken generally along the line 2—2 in FIG. 1.

Referring now to the drawing in detail, and initially to FIG. 1, numeral 10 generally designates a building having a ventilated wall drainage system of the present invention. The building 10 has a roof 12 with a plurality of roof vents (not pictured) therein near an apex of the roof, a soffit 14, an attic 16 immediately below the roof and providing attic space and a wall construction 18. As illustrated in FIG. 2, the roof is generally of standard construction having a plurality of rafters 20 and ceiling joist 22. Roofing material 24 is attached to an upper surface of the rafters 20. The roofing material 24 can be of any type known in the industry, such as plywood or OSB covered with asphalt shingles (as illustrated), furring strips covered with cedar shake shingles, etc.

The soffit 14, but for the modifications discussed in greater detail below, is also generally of standard construction. The soffit includes a soffit stringer 26, soffit joists 28 and soffit sheathing 30. The soffit stringer 26 is preferably an elongate framing member, often a piece of dimensional lumber such as a 2×4, which is generally parallel to and attached to the wall construction 18. A plurality of the soffit joists 28 extend generally perpendicularly outward from the soffit stringer 26 and are coupled at distal ends 32 to the lower ends 34 of the rafters 20, which are also known as the rafter tails. The soffit sheathing 30 is attached to the underside of the soffit joists 28 and a fascia 36 is attached to the lower ends 34 of the rafters 20. A gutter (not pictured) is generally then attached to the fascia 36.

In standard construction, the soffit 14 also includes a plurality of soffit vents (not pictured). The soffit vents generally take the shape of holes cut in the soffit sheathing 30 between the soffit joists 28 which are covered with screen material. The soffit vents permit air to flow through the vents and up into the attic space. The soffit vents cooperate with the roof vents to provide circulation of air in the attic and thereby assist with cooling the attic on hot days. As convection causes hot air in the attic to rise and exit the roof through the roof vents, a lower air pressure is created in the attic. The lower air pressure draws air into the attic through the soffit vents of the prior art. As the new air in the attic warms, it also rises through the roof vents and the cycle continues. This naturally occurring convection helps ventilate and cool the attic space as well as remove moisture and humidity therefrom.

Figure 3:
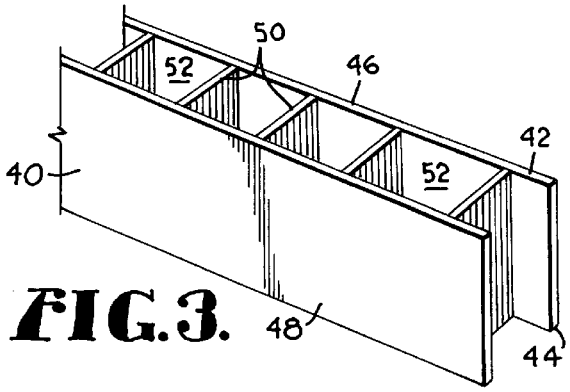
FIG. 3 is a perspective view of a spacer of the present invention.

In the present invention, the soffits do not include the soffit vents of the prior art but, instead, include an opening or passage 38 therethrough which cooperates with the wall construction as described in greater detail below. In a preferred embodiment and as illustrated, the passage 38 is a spacer 40 as best viewed in FIG. 3. The spacer is preferably an elongate member having an upper edge 42, a lower edge 44, a first wall 46, a second wall 48 and a plurality of cross walls 50. The first and second walls 46, 48 are spaced apart from each other and are in a generally parallel relationship. The first and second walls 46, 48 are spaced apart from each other by the cross walls 50. The plurality of cross walls 50 between the first and second walls 46, 48 create a plurality of tunnels 52 therethrough. The tunnels 52 are generally vertical in nature and permit air to freely flow therethrough.

Figure 4:
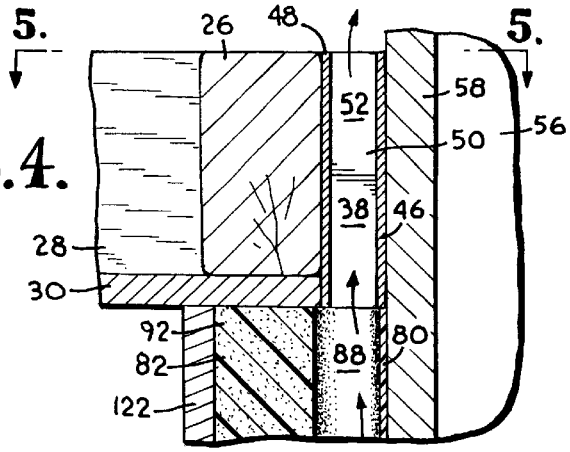
FIG. 4 is an enlarged cross-sectional view taken generally around the area 4 of FIG. 2 and illustrating the relationship between a soffit, the spacer and an exterior wall.

The spacer 40 is preferably a plastic product which permits fasteners to be driven therethrough, although the spacer 40 could be made of any suitable material, including wood. The spacer 40, when used in connection with a standard 2×4 dimensional lumber soffit stringer 26 (actual size 1½"×3½") and one half inch soffit sheathing 30, is preferably three quarters of inch thick by four inches tall (¾"×4") and preferably in eight foot lengths. These dimensions can be modified as needed, however, these dimensions permit the soffit stringer 26 and the soffit sheathing 30 to completely butt up against the second wall 48 of the spacer 40, as illustrated in FIGS. 2 and 4.

Other embodiments of the spacer 40 which provide for cooperation between the passage 38 in the soffit 14 and the wall construction 18, as described in greater detail below, are contemplated and well within the scope of the present invention. For example, the spacer could be a piece of lumber with a plurality of through dados therein or a plurality of holes could be bored through the soffit sheathing 30 and the soffit stringer 26 to provide the passage 38.

The wall construction 18 of the present invention includes an exterior wall 54 having a plurality of framing members or studs 56 with sheathing material 58 fastened thereto to form an exterior surface 60. The exterior wall 54 preferably also includes a bottom plate 62 and one or two top plates 64. The bottom plate 62 is generally fastened to lower ends 66 of the studs 56 and the top plates 64 are generally fastened to upper ends 68 of the studs 56. The building preferably also includes, in accordance with common construction principals, a subfloor 70, an end joist 72, a floor joist 74, a sill plate 76 and a foundation 78. The arrangement and function of these items are well known in the art. The exterior surface 60 of the exterior wall 54 is preferably covered with a house wrap or vapor barrier 80. The house wrap 80 functions to prevent air and/or water from infiltrating the exterior wall 54 from the outside.

The wall construction 18 also includes insulation 82. The insulation is preferably a foam material, such as expanded polystyrene, and generally takes the shape of a rigid sheet. This sheet of insulation preferably includes a rear surface 84 and a front surface 86. The rear surface 84 preferably includes a plurality of channels 88 therein. The insulation 82 is fastened to the exterior wall 54 with mechanical fasteners such that the rear surface 84 of the insulation 82 faces the exterior surface 60 of the exterior wall 54 and, in a preferred embodiment, abuts the house wrap 80. The insulation 82 can of course be adhered to the exterior wall 54, however mechanical fasteners have been found beneficial. Additionally, while the insulation is disclosed as preferably being generally rigid, non-rigid insulation could be used in certain instances provided channels were provide through the insulation. When the insulation 82 is fastened to the exterior wall 54 in the manner discussed above, the channels 88 cooperate with the exterior surface 60 of the wall to permit air to flow through the channels 88 and between the insulation 82 and the exterior wall 54. Preferably, the channels 88 are arranged in a vertical orientation and extend from a bottom end 90 of the insulation adjacent the foundation 78 to a top end 92 adjacent the opening 38 in the soffit 14 and, in a preferred embodiment, adjacent the spacer 40.

In this arrangement, as best illustrated in FIG. 5, the channels 88 in the insulation 82 align with, communicate with and cooperate with the tunnels 52 in the spacer in the soffit 14 to permit air to freely flow therethrough. As air exits the attic 16, new air is drawn into the channels 88 in the insulation at the bottom end 90. The air then rises up through the channels 88 passing between the insulation 82 and the exterior wall 54. The air then exits the channels 88 at the top end 92 of the insulation 82 and enters the tunnels 52 of the spacer 40 at its lower edge 44. The air travels through the tunnels 52 and exits the spacer 40 at its upper edge 42. The air is then in the soffit 14 and can freely rise up over the top of the exterior wall 54 between the rafters to enter the attic space and ultimately exit through the attic vents.

While the foregoing illustrates the principle of the present invention of providing a ventilated wall drainage system, modifications to the system can be made as desired. One modification which is contemplated is the inclusion of a generally L-shaped insulation support bracket 94 as illustrated in FIG. 8. The bracket has a back wall 96 and a bottom wall 98. The bottom wall 98 has a front edge 100. The bottom wall 98 preferably includes a plurality of apertures 102 therethrough adjacent the back wall 96. The apertures 102 permit air to flow through the bracket 94, as best illustrated in FIG. 7, and into the channels 88 in the insulation 82. The bracket is preferably fastened to the bottom of the exterior wall 54 adjacent the foundation 78. The apertures 102 not only let air flow therethrough but, should moisture get between the insulation 82 and the exterior wall 54, allow the moisture to exit the channels 88 by flowing downwardly therethrough.

The bracket 94 helps support the insulation 82 before, during and after it is fastened to the exterior wall 54. J-channels have been used in the prior art to receive a portion of the insulation 82 anc can be used with the present invention provided they also have apertures 102 therein. The bracket 94, however, has been found beneficial in that, unlike a J-channel which has a piece that covers the front surface 86 of the insulation 82, the bottom wall 98 of the bracket 94 stops short of the front surface 86 and the insulation 82 sticks out beyond the front edge 100. This arrangement permits the front surface 86 of the insulation 82 to be shaved or planed down to remove ridges or other imperfections in the exterior wall 54 or to smooth transitions from one panel of insulation 82 to another.

Similar to the bracket 94, it is contemplated that a user of this system would use a track member 104 above a window unit 106 as best illustrated in FIG. 6. The track member 104 is generally L-shaped member having a back wall 108, a bottom wall 110 and an upwardly extending flange 112. The flange 112 and the back wall 108 cooperate with the bottom wall 110 to define a trough 114. A lower rear portion of the insulation is beveled off to provide a generally horizontal opening 116 in and above the trough 114. The trough extends across the top of the window unit 106 such that any water which might flow through the channels 88 above the window 106 will be caught in the trough 104 and will be directed to the sides of the window where it can enter into other channels in the insulation 82 which go all the way to the bottom of the exterior wall 54 to permit the water to exit therefrom. The bracket 94 and the track member 104 are preferably attached to the exterior wall 54 of the building 10 via fasteners 118. The fasteners 118 can be nails or screws or any other type of mechanical fastener and are driven into the sheathing material 58. If a stronger connection is desired, the fasteners can also extend through the sheathing material 58 and into the sill plate 76 for the bracket 94 or a header 120 for the track member 104.

The wall construction 18 of the building 10 also includes an exterior siding material or exterior covering 122. While the present invention was designed to be used with and was illustrated with an exterior siding such as synthetic stucco, it is within the scope of the present invention to use the present invention with sidings such as brick, stone, lap siding, sheathing and the like.

In practice, the ventilated wall drainage system of the present invention is constructed by first building the exterior wall 54. The framing members 56, bottom plate 62 and top plate 64 are preferably fastened together and the sheathing material 58 is attached thereto. The exterior wall is then generally lifted to its upright position and secured in place. The exterior surface 60 of the sheathing material 58 is then covered with the house wrap or vapor barrier 80. If brackets 94 are to be used, they are then fastened to the exterior wall 54. The insulation 82 is then supported on top of the bracket 94 and fastened to the exterior wall 54. The siding material 122 is then applied to the exterior surface of the insulation 82.

Various other modifications can be made to the wall construction of the present invention and still be considered within the scope of the present invention. For example, the passage 38 can be the soffit vents of the prior art provided they cooperate with the channels 88 in the insulation 82 as disclosed herein to draw air upwardly therethrough. This can be accomplished by covering the soffit vents with a large crown molding type piece such that the soffit vents are not visable from the exterior of the building, but instead are forced to draw air up through the channels 88 in the insulation 82.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A method of constructing a building having a ventilated wall system, the building having a roof with a plurality of roof vents therein, the method comprising:

building an exterior wall of the building, the wall having upper and lower edges, wherein the wall includes a plurality of framing members spaced apart in predetermined intervals, wherein a plurality of the framing members are generally parallel to each other and wherein the generally parallel framing members are aligned in a plane that defines the exterior wall;

covering the framing of the exterior wall with a plurality of sheet goods to form an exterior surface of the wall;

covering the exterior surface with a plurality of foam sheet goods, wherein the foam sheet goods have an inner surface and an outer surface, wherein the inner surface includes a plurality of longitudinal channels and wherein the channels extend between the upper and lower edges of the wall; and providing the house with a soffit having a lower surface, wherein the lower surface has an elongate opening therein, wherein the opening cooperates with the channels and wherein air can flow through the channels, through the opening and through the roof vents.

2. The method of claim 1, further comprising covering the outer surface of the foam sheet goods with an exterior siding material.

3. The method of claim 2, wherein the exterior siding material is selected from the group comprising stucco, brick, stone, lap siding and panels.

4. The method of claim 2, wherein the soffit includes framing members and sheet goods and wherein the opening is formed by spacing at least the sheet goods of the soffit away from the sheet goods of the wall.

5. The method of claim 4, wherein the sheet goods of the soffit are spaced away from the sheet goods of the wall via a spacer.

6. The method of claim 5, wherein the spacer is an elongate member having an upper edge, a lower edge, and first and second surfaces, and wherein the spacer has a plurality of tunnels extending therethrough between the upper and lower edges.

7. The method of claim 6, wherein the spacer is a plastic-like material and wherein the tunnels are made when the spacer is formed.

8. In a building having a wall construction, a soffit, a roof, a roof vent in said roof, and attic space located between the soffit and the roof, the improvement comprising:

an exterior wall in said wall structure, said exterior wall having a plurality of framing members, sheathing material fastened to said framing members, insulation adjacent said sheathing material, and an exterior covering adjacent said insulation, wherein said insulation is intermediate said sheathing material and said exterior covering, wherein said insulation provides a plurality of channels which permit air to flow from a bottom of said exterior wall to a top of said exterior wall, wherein said insulation is a generally rigid foam product and is provided in the form of sheets, and wherein said channels are formed in said insulation in a rear surface thereof and said channels are generally vertical in nature; and a passage in said soffit providing communication between said attic space and said channels whereby air may flow through said channels, through said passage, through said attic and through said roof vent.

9. In a building having a wall construction, a soffit, a roof, a roof vent in said roof, and attic space located between the soffit and the roof, the improvement comprising:

an exterior wall in said wall structure, said exterior wall having a plurality of framing members, sheathing material fastened to said framing members, generally rigid insulation adjacent said sheathing material, and an exterior covering adjacent said insulation, wherein said insulation is intermediate said sheathing material and said exterior covering, and wherein said insulation provides a plurality of channels which permit air to flow from a bottom of said exterior wall to a top of said exterior wall, wherein said channels are formed in said insulation and wherein said channels are generally vertical in nature;

a passage in said soffit providing communication between said attic space and said channels whereby air may flow through said channels, through said passage, through said attic and through said roof vent a spacer, wherein said spacer is an elongate member having an upper edge, a lower edge, and first and second side surfaces, wherein said spacer has a plurality of tunnels extending therethrough between the upper and lower edges, and wherein said spacer provides said passage.

10. The improvement of claim 9, wherein convection naturally draws air upwardly through an opening in the bottom of said wall, through said channels, through said spacer, through said attic space and out said roof vent.

11. The improvement of claim 9, wherein said spacer has first and second walls and a plurality of cross-walls, wherein said first and second walls are in a spaced apart and generally parallel relationship, wherein said cross-walls are located between said first and second walls and are generally perpendicular thereto, and wherein said cross-walls maintain said first and second walls in said spaced relationship.

12. The improvement of claim 11, wherein said spacer is approximately one inch thick and four inches tall.

13. The improvement of claim 12, wherein said soffit includes a framing member which is generally parallel said exterior wall, wherein said spacer is intermediate said soffit framing member and said exterior wall and wherein said soffit framing member is attached to said exterior wall by fasteners which pass through said soffit framing member, through said spacer and into said exterior wall.

14. The improvement of claim 13, wherein said lower surface of said spacer is adjacent a top edge of said insulation whereby said tunnels cooperate with said channels, wherein said soffit further includes sheathing which is fastened to said soffit framing and which is generally perpendicular to said sheathing of said exterior wall, wherein soffit sheathing has an inner edge, and wherein said inner edge of said soffit sheathing is spaced apart from said exterior wall by said spacer.

15. The improvement of claim 14, further comprising an insulation support bracket attached to the exterior wall adjacent the bottom, wherein said bracket abuts a portion of the insulation, wherein a bottom of said bracket includes a plurality of apertures therethrough, and wherein said channels in said insulation communicate with said apertures in said bracket to permit air to flow through said apertures and into said channels.

* * * * *